US006071140A

United States Patent [19]

McHugh et al.

[11] Patent Number: 6,071,140

[45] Date of Patent: Jun. 6, 2000

[54] SOCKET CONNECTOR

[75] Inventors: Robert G. McHugh, Evergreen, Colo.; Nick Lin, Hsin-Chuang, Taiwan

[73] Assignee: Hon Hai Precision Ind. Co., Ltd., Taipei Hsien, Taiwan

[21] Appl. No.: 09/295,615

[22] Filed: Apr. 20, 1999

[51] Int. Cl.[7] ..... H01R 4/50

[52] U.S. Cl. ..... 439/342; 439/259; 439/266

[58] Field of Search ..... 439/342, 259, 439/265, 266, 268

[56] References Cited

U.S. PATENT DOCUMENTS

| | | | |
|---|---|---|---|
| 4,420,205 | 12/1983 | Kirkman | 439/342 |
| 5,855,489 | 1/1999 | Walker | 439/342 |
| 6,004,152 | 12/1999 | Walkup et al. | 439/342 |
| 6,017,234 | 1/2000 | Walkup et al. | 439/266 |
| 6,022,236 | 2/2000 | McHugh et al. | 439/342 |

*Primary Examiner*—Paula Bradley
*Assistant Examiner*—Tho D. Ta
*Attorney, Agent, or Firm*—Wei Te Chung

[57] ABSTRACT

A socket connector includes a fixed base and a movable cover slidably positioned on the base for moving between a closed position and an open position. A control plate is movably retained between the base and the cover and defines first and second holes, each having an arcuate edge and an opposite straight edge. A bore reinforced by a metal collar is defined in the cover for rotatably receiving a screwdriver. The control plate is manually moved between first and second positions corresponding to the closed and open positions of the cover whereby the first and second holes selectively align with the bore. When closing/opening the cover, the screwdriver is inserted into the first/second hole through the bore with an edge thereof engaging with the bore whereby rotating the screwdriver moves the cover toward the closed/open positions.

9 Claims, 7 Drawing Sheets

SOCKET CONNECTOR

BACKGROUND OF THE INVENTION

1. Field of the Invention

The present invention generally relates to a socket connector, and in particular to an actuation mechanism of a socket connector.

2. The Prior Art

Socket connectors, such as ZIF connectors, are well known in the electronics field for connecting an electronic device, such as a central processing unit module, to a circuit board. A socket connector comprises a movable cover and a fixed base. The base defines a plurality of bores in which contact elements are retained for being soldered to a circuit board. The cover defines holes corresponding to the bores of the base. An electronic device is positioned on the cover with pins thereof extending through the holes and partially into the bores whereby when the cover is moved with respect to the base from an open position to a closed position, the pins are brought into engagement with the contact elements for establishing electrical engagement between the electronic device and the circuit board.

The cover is bi-directionally movable for selectively opening/closing the connector. Two sets of actuation mechanisms are provided on opposite sides of the base for moving the cover in opposite directions. Such a design is space inefficient since the two sets of actuation mechanisms occupy a large amount of space.

It is thus desirable to have a socket connector having a single actuation mechanism for reducing the amount of space occupied thereby.

SUMMARY OF THE INVENTION

Accordingly, an object of the present invention is to provide a socket connector having a single actuation mechanism for reducing the amount of space occupied thereby.

Another object of the present invention is to provide a socket connector having an actuation mechanism with a simple structure.

A further object of the present invention is to provide a socket connector having a reinforced actuation mechanism for protecting the connector from damage caused by the actuation thereof.

To achieve the above objects, a socket connector in accordance with the present invention comprises a fixed base and a movable cover slidably positioned on the base for moving between a closed position and an open position. A control plate is movably retained between the base and the cover and defines first and second holes, each having an arcuate edge and an opposite straight edge. A bore reinforced by a metal collar is defined in the cover for rotatably receiving a screwdriver. The control plate is manually moved between first and second positions corresponding to the closed and open positions of the cover whereby the first and second holes selectively align with the bore. When closing/opening the cover, the screwdriver is inserted into the first/second hole through the bore with an edge thereof engaging with the bore whereby rotating the screwdriver moves the cover toward the closed/open positions.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
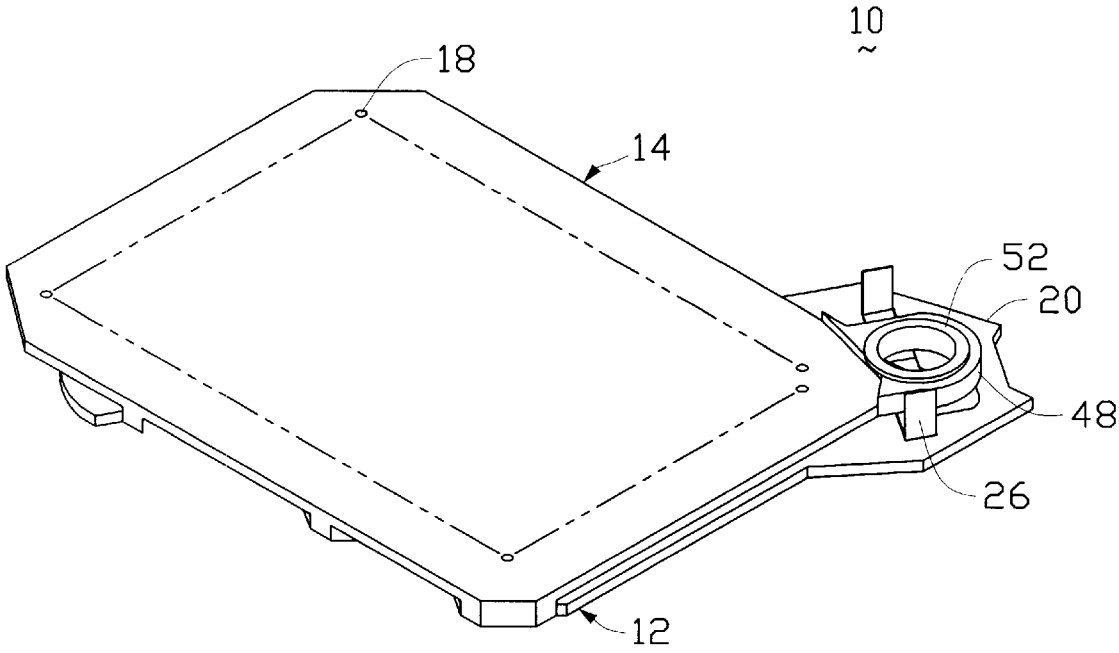
FIG. 1 is a perspective view of a socket connector constructed in accordance with the present invention
Figure 2:
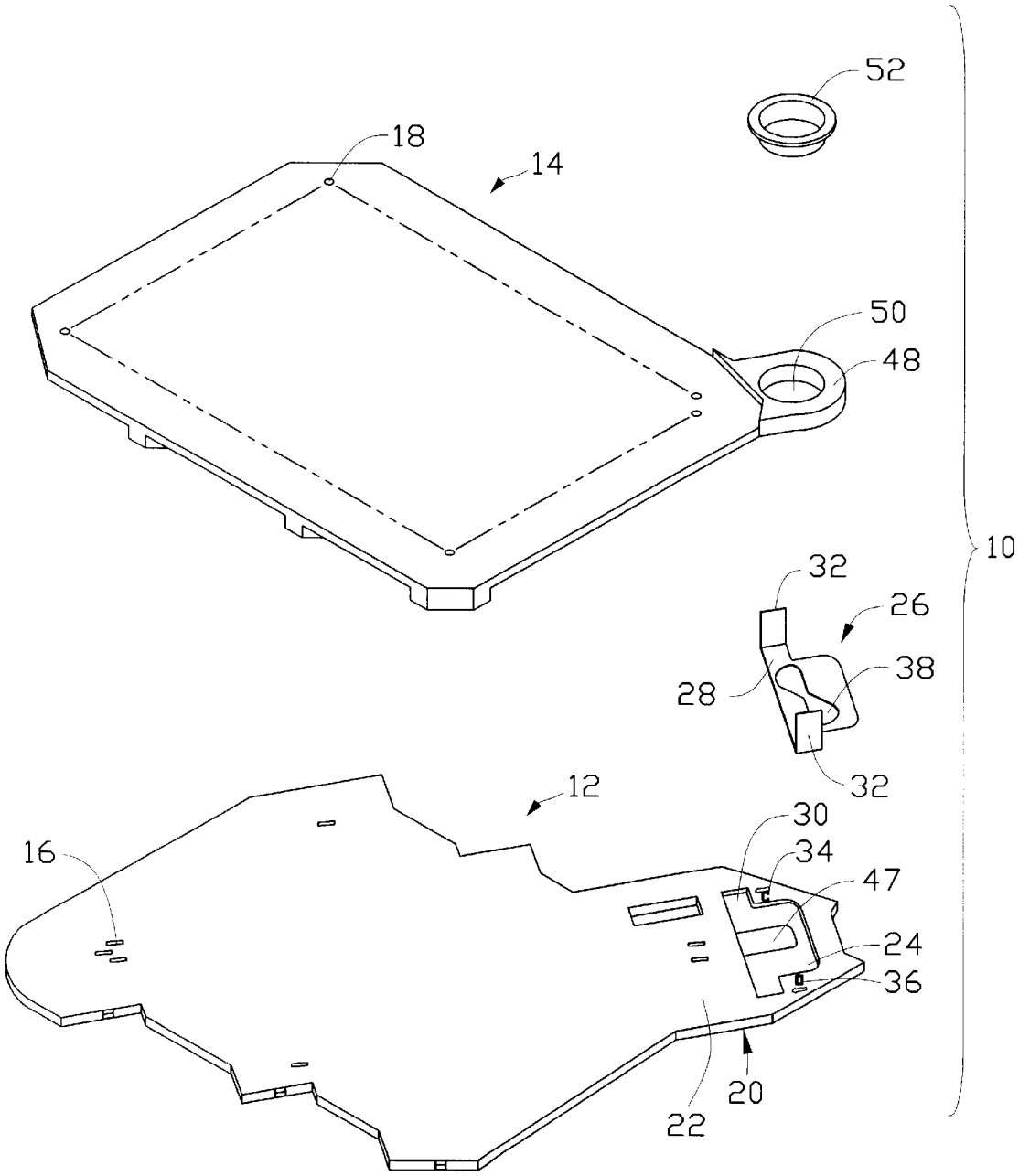
FIG. 2 is an exploded view of FIG. 1.
Figure 6:
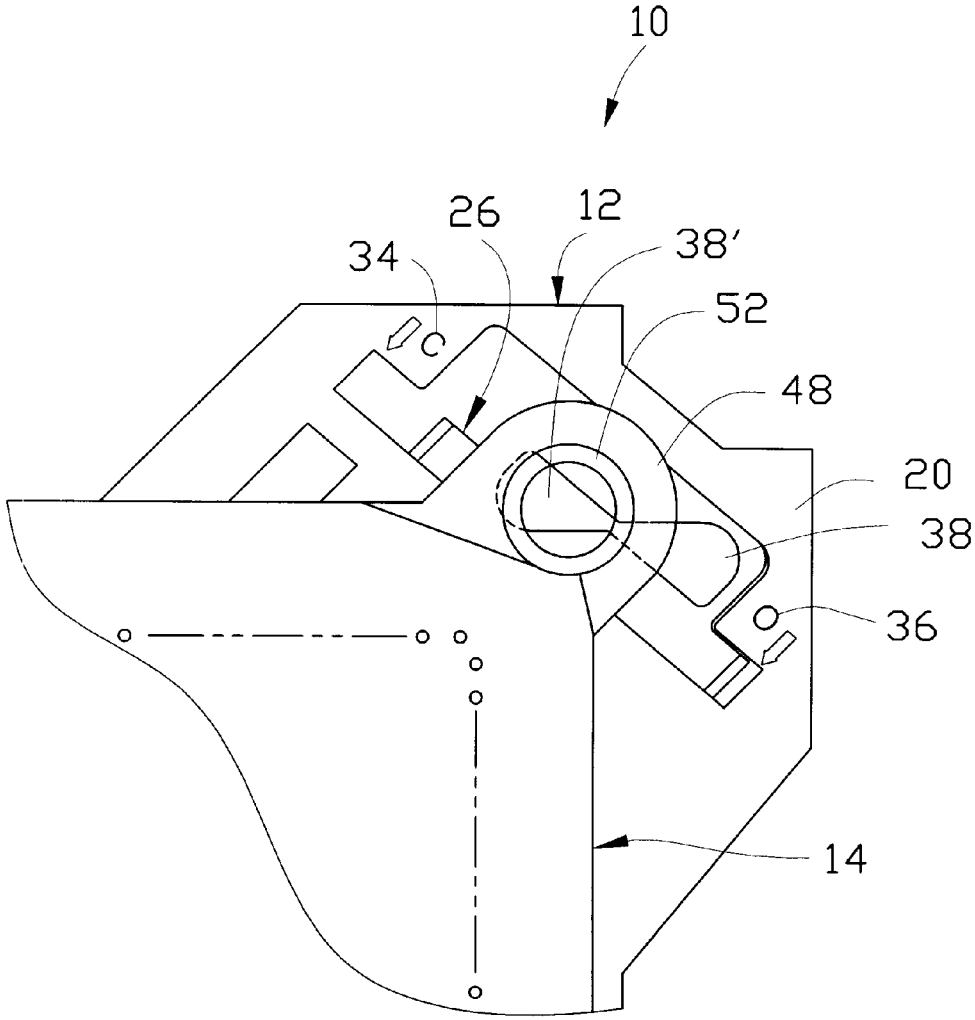
FIG. 6 is a partial, top view of the socket connector showing the cover at the open position.

Referring to the drawings and in particular to FIGS. 1 and 2, a socket connector 10 in accordance with the present invention comprises a fixed base 12 adapted to be mounted to a circuit board (not shown) and a movable cover 14 slidably mounted on the base 12 and movable between a closed position (FIG. 4) and an open position (FIG. 6). The base 12 and the cover 14 are both made of insulative material. The base 12 defines a plurality of bores 16 therein for each retaining a conductive contact element (not shown). The cover 14 is adapted to retain an electronic device (not shown), such as a central processing unit module, thereon and defines a plurality of through holes 18 for receiving pins of the electronic device. The pins extend through the holes 18 and partially into the corresponding bores 16 of the base 12 whereby when the cover 14 is moved with respect to the base 12 from the open position to the closed position, the pins are brought into engagement with the corresponding contact elements.

An actuation mechanism 20 is provided on one corner of the base 12 for moving the cover 14 between the closed position and the open position. The actuation mechanism 20 comprises an extension 22 formed on the corner of the base 12. A recess 24 is defined in the extension 22 for movably receiving a direction control plate 26. The direction control plate 26 is manually movable within the recess 24 between a first position corresponding to the closed position of the cover 14 (FIG. 4) and a second position corresponding to the open position of the cover 14 (FIG. 6). For simplicity, the first and second positions of the direction control plate 26 will be hereinafter referred to as closed and open positions.

The direction control plate 26 has two end extensions 28 respectively received in two guide slots 30 formed in the extension 22 of the base 20 in communication with the recess 24 for guiding the movement of the direction control plate 26 within the recess 24. Each end extension 28 of the direction control plate 26 has a tab 32 perpendicularly extending therefrom beyond the cover 14 for facilitating manual movement of the direction control plate 26. Preferably, marks 34, 36 indicating the closed position and the open position of the direction control plate 26 are provided on the extension 22 of the base 12 for visual observation purposes.

Figure 3:
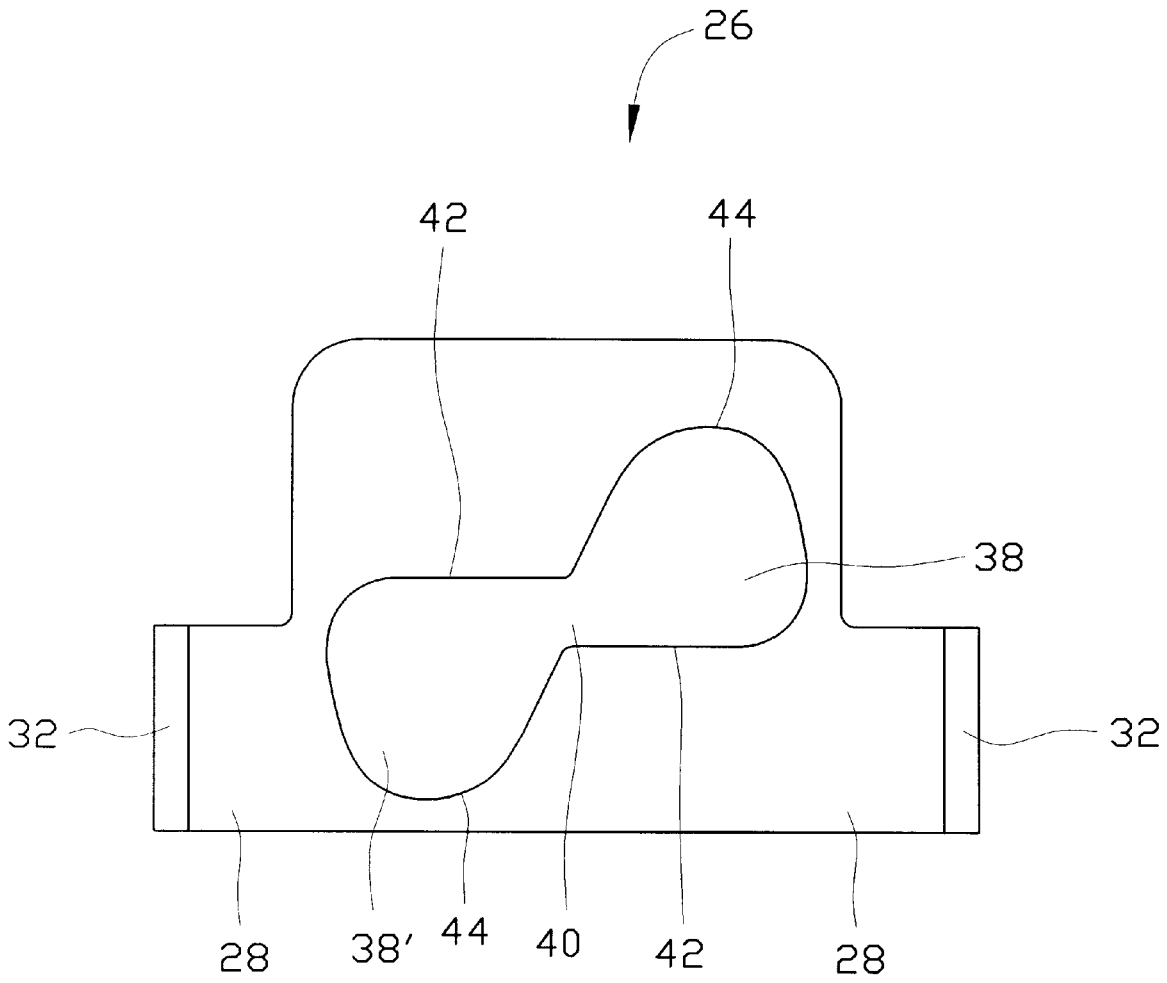
FIG. 3 is a top view of a direction control plate of an actuation mechanism of the socket connector.

As shown in FIG. 3, the direction control plate 26 defines two holes 38, 38' respectively associated with operations of opening and closing the cover 12. Thus, the holes will be referred to as closing hole 38 and opening hole 38'. In the embodiment illustrated, a passage 40 is defined in the direction control plate between the holes 38, 38' thereby forming a single opening. However, it is not necessary for the holes 38, 38' to be connected together. Each hole 38, 38' has a straight edge 42 and an arcuate edge 44. The holes 38, 38' are symmetrical about a common center. In other words, the arcuate edges 44 of the closing hole 38 and the opening hole 38' are located on opposite sides with respect to the straight edges 42 thereof. The arcuate edge 44 of the closing hole 38 is distanced from the base 12, while the arcuate edge 44 of the opening hole 38' is proximate the base 12.

Referring back to FIGS. 1 and 2, an external tool, such as a screwdriver 46 (FIG. 5), may be received and rotated in each hole 38, 38'. The arcuate edge 44 provides a space for accommodating the rotation of the screwdriver 46, while the straight edge 42 supports the screwdriver 46. This will be further discussed in detail. A cavity 47 may be further defined in the recess 24 of the base 12 for partially receiving a tip of the screwdriver 46.

The cover 14 has an extension 48 engaging with the extension 22 of the base 12 for movably retaining the direction control plate 26 in the recess 24 of the base 12. An actuation bore 50 is defined through the extension 48 of the cover 14. The bore 50 selectively aligns with the holes 38, 38' of the direction control plate 26 with the movement of the direction control plate 26 thereby allowing the screwdriver 46 to be inserted through the bore 50 into either of the holes 38, 38'. Preferably, a collar 52 made of rigid material, such as metal, is fixed in the bore 50 for protecting of the bore 50 from damage caused by rotation of the screwdriver 46.

Figure 4:
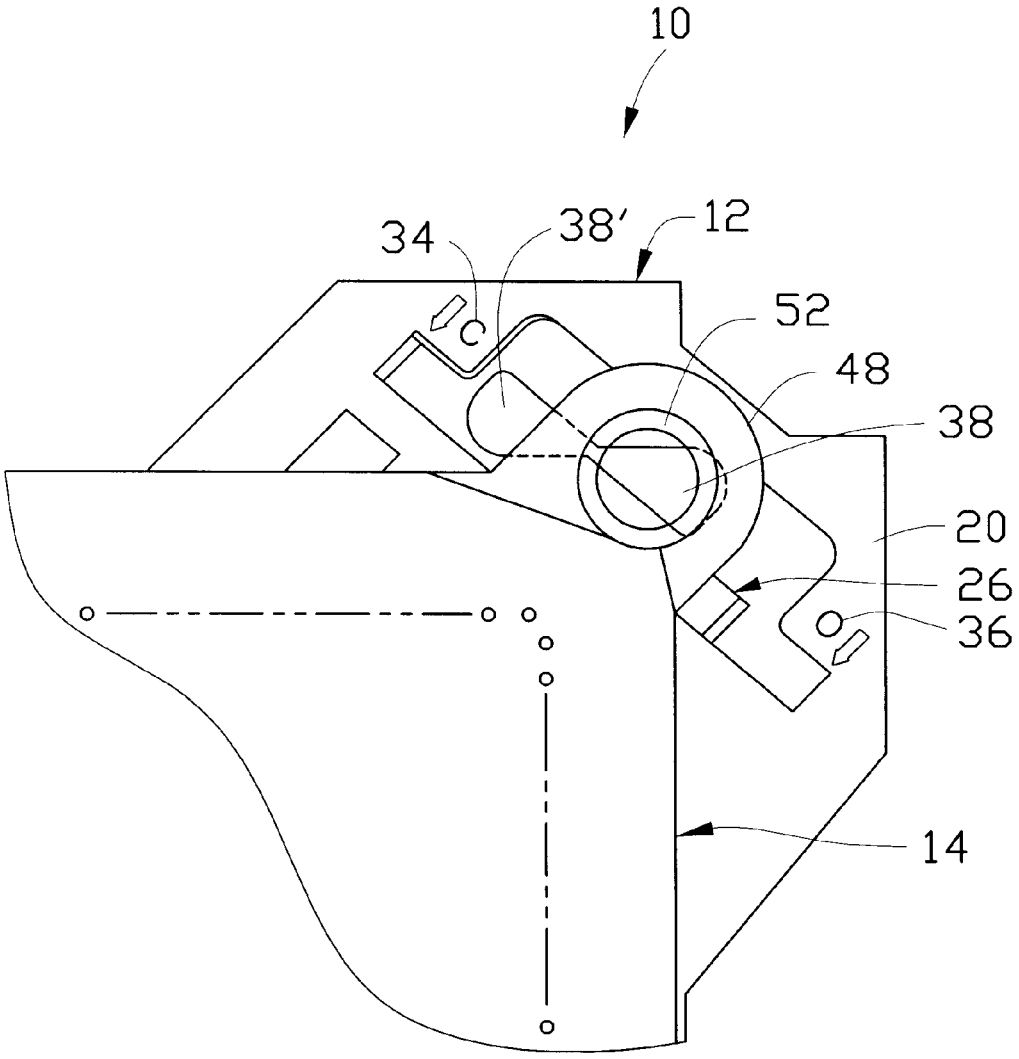
FIG. 4 is a partial, top view of the socket connector showing a cover at a closed position.
Figure 5:
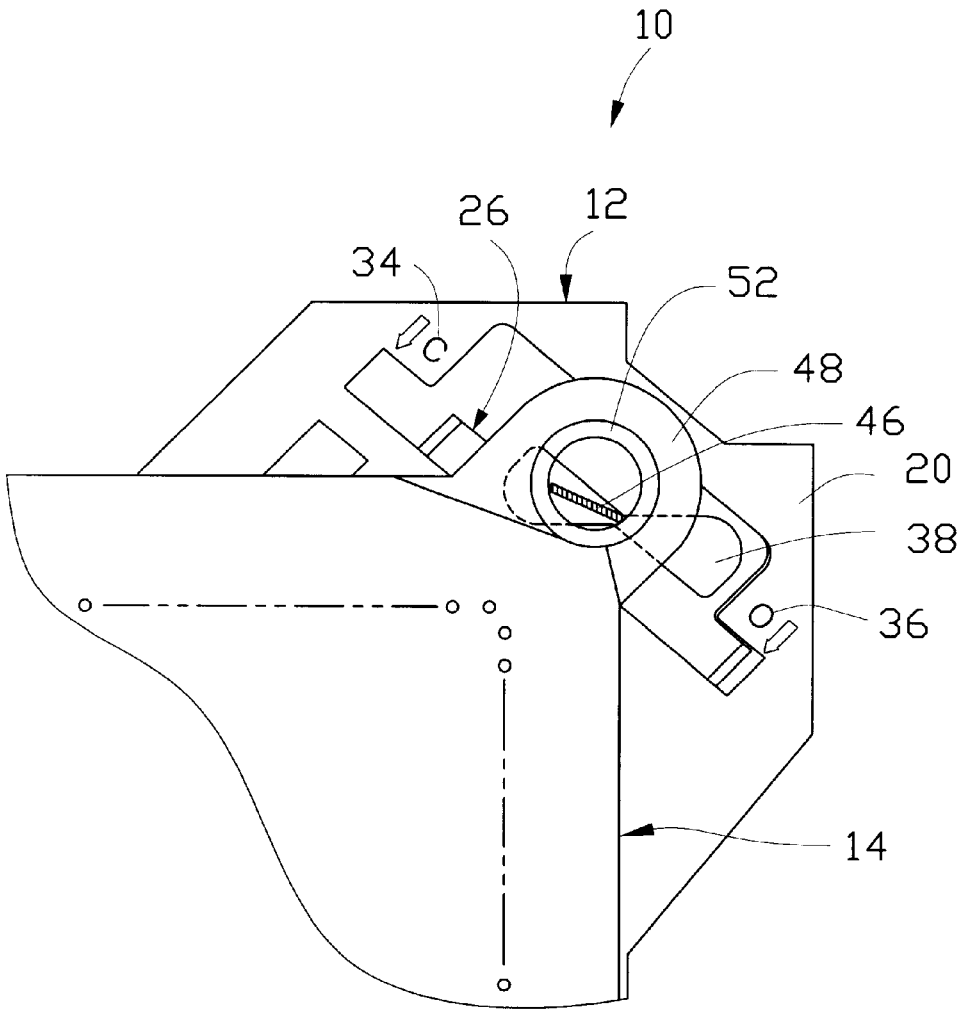
FIG. 5 is similar to FIG. 4 but showing a screwdriver operating the actuation mechanism for moving the cover from the closed position to an open position.

Referring to FIGS. 4–7, a cyclical opening/closing operation of the cover 14 is shown. FIG. 4 shows the closed position of the cover 14 where the direction control plate 26 is located at the closed position. When opening the cover 14, the direction control plate 26 is manually moved to the open position whereby the bore 50 of the cover 14 aligns with the opening hole 38', as shown in FIG. 5. A screwdriver 46 is inserted into the opening hole 38' of the direction control plate 26 through the bore 50 of the cover 14 and engages with the bore 50 in an offset fashion. The screwdriver 46 is rotated with an edge thereof supported by the straight edge 42 of the opening hole 38 whereby, due to the engagement between the bore 50 and another edge of the screwdriver 46, the cover 14 is moved toward the open position as shown in FIG. 6.

Figure 7:
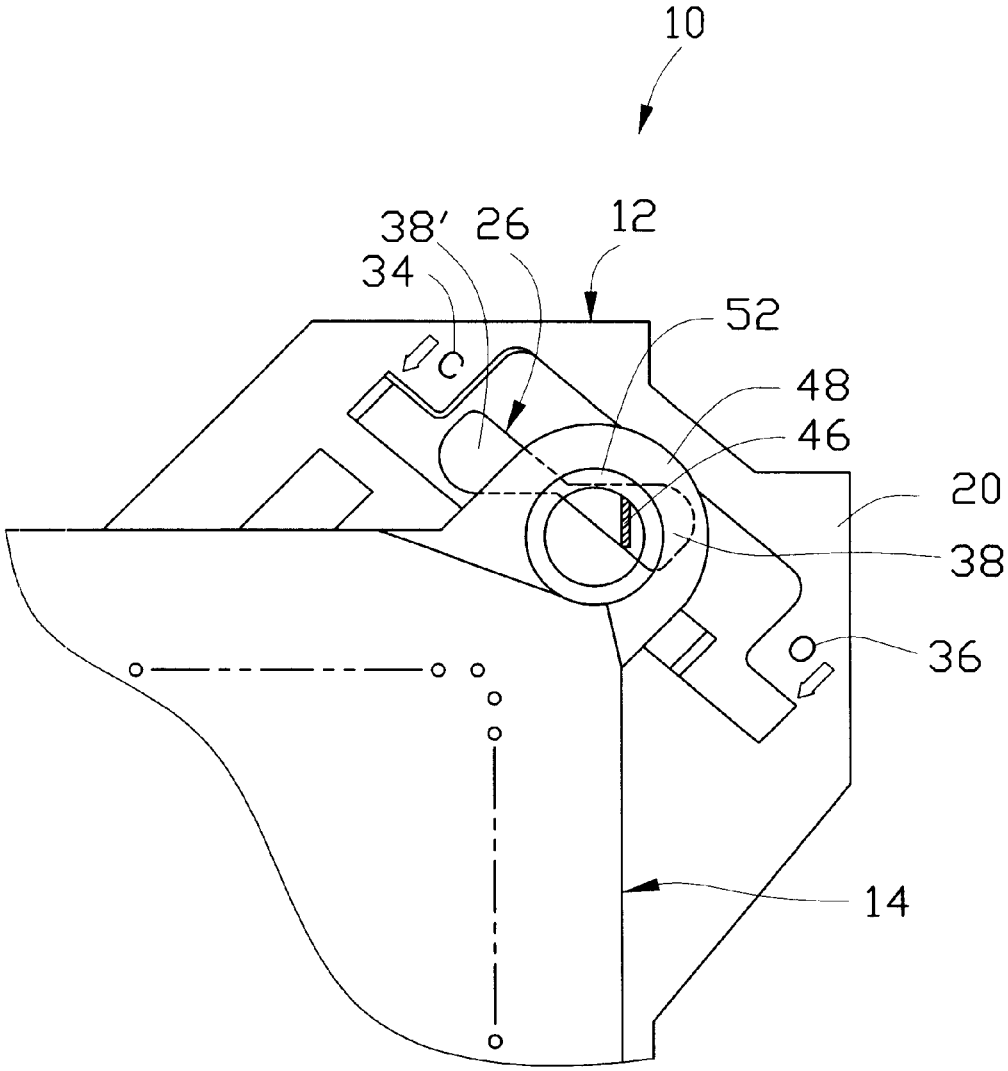
FIG. 7 is similar to FIG. 6 but showing a screwdriver operating the actuation mechanism for moving the cover from the open position to the closed position.

When closing the cover 14, the direction control plate 26 is manually moved from the open position to the closed position as shown in FIG. 7 whereby the bore 50 of the cover 14 aligns with the closing hole 38. The screwdriver 46 is inserted into the closing hole 38 of the direction control plate 26 through the bore 50 of the cover 14 and engages with the bore 50 in an offset fashion. The screwdriver 46 is rotated with an edge thereof supported by the straight edge 42 of the closing hole 38 whereby, due to the engagement between the bore 50 and another edge of the screwdriver 46, the cover 14 is moved toward the closed position as shown in FIG. 4.

Since the arcuate edges 44 of the closing hole 38 and the opening hole 38 are located at opposite sides, the rotation of the screwdriver 46 in the holes 38, 38' drives the cover 14 in opposite directions thereby achieving closing/opening the cover 14. The passage 40 between the holes 38, 38' allows a user to cyclically open/close the cover 14 without repeatedly moving the screwdriver 46 from one hole to the other.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A socket connector comprising:

a fixed base comprising a first extension forming a recess therein;

a control plate received in the recess and movable between a first position and a second position, first and second holes being defined in the control plate, each having a straight edge and an arcuate edge, the arcuate edges being located opposite the straight edges; and a movable cover positioned on the base and movable between a closed position and an open position, the cover comprising a second extension engaging with the first extension for movably retaining the control plate in the recess, a bore being defined in the second extension for selectively aligning with the first and second holes of the control plate when the control plate is located at the first and second positions;

wherein the bore is adapted to receive an external tool with a tip of the tool being selectively received in the holes of the control plate whereby by rotating the external tool in the hole with a first edge of the tool supported by the straight edge thereof and a second edge of the tool engaging with the bore, the cover is selectively moved in opposite directions between the open position and the closed position.

2. The socket connector as claimed in claim 1, wherein the control plate has projections extending beyond the cover for facilitating manual movement of the control plate with respect to the base.

3. The socket connector as claimed in claim 1, wherein the control plate comprises at least one extension movably received in a slot defined in the base for being guided thereby to move between the first and second positions.

4. The socket connector as claimed in claim 1, wherein marks are formed on the base for indicating the first and second positions of the control plate.

5. The socket connector as claimed in claim 1, wherein marks are formed on the base for indicating the closed and open positions of the cover.

6. The socket connector as claimed in claim 1, wherein a cavity is defined in the recess of the base for accommodating the tip of the external tool.

7. The socket connector as claimed in claim 1, wherein a passage is formed between the holes of the control plate.

8. The socket connector as claimed in claim 1, wherein a reinforced collar is fixed in the bore of the cover for protection of the bore.

9. The socket connector as claimed in claim 8, wherein the collar is made of metal.

* * * * *